US007490371B2

(12) United States Patent
Torres

(10) Patent No.: US 7,490,371 B2
(45) Date of Patent: Feb. 17, 2009

(54) SHOWER RECEPTOR

(75) Inventor: Raymond C. Torres, Moreno Valley, CA (US)

(73) Assignee: Lasco Bathware, Inc., Anaheim, CA (US)

( * ) Notice: Subject to any disclaimer, the term of this patent is extended or adjusted under 35 U.S.C. 154(b) by 485 days.

(21) Appl. No.: 10/910,733

(22) Filed: Aug. 3, 2004

(65) Prior Publication Data

US 2006/0026752 A1 Feb. 9, 2006

(51) Int. Cl.
*A47K 3/00* (2006.01)

(52) U.S. Cl. ..... 4/613; 4/612

(58) Field of Classification Search ..... 4/612–613, 4/538, 584, 596; D23/283; 220/608, 571–572
See application file for complete search history.

(56) References Cited

U.S. PATENT DOCUMENTS

| | | | | | |
|---|---|---|---|---|---|
| 1,017,167 | A | * | 2/1912 | Pleins | 4/613 |
| 1,107,167 | A | * | 8/1914 | Pliens | 223/8 |
| 1,604,810 | A | * | 10/1926 | Crist | 4/557 |
| 1,664,491 | A | * | 4/1928 | Siegel | 4/557 |
| 2,343,201 | A | * | 2/1944 | Nilson | 52/264 |
| 2,545,350 | A | * | 3/1951 | Fuld | 222/484 |
| 2,757,385 | A | | 8/1956 | Whittick | |
| 3,363,267 | A | | 1/1968 | Kaiser et al. | |
| 3,800,335 | A | | 4/1974 | Buonaura | |
| 5,297,301 | A | * | 3/1994 | Sodrel | 4/613 |
| D363,342 | S | * | 10/1995 | Dannenberg et al. | D23/283 |
| D367,522 | S | | 2/1996 | Debs | D23/283 |
| 5,768,842 | A | | 6/1998 | Austin | |
| 6,226,808 | B1 | * | 5/2001 | Walshe | 4/552 |
| 6,643,863 | B1 | | 11/2003 | Gerber | |
| 2004/0034922 | A1 | | 2/2004 | Grayson | |

OTHER PUBLICATIONS

The Swanstone Corporation, "Shower Floor Installation Instructions", Dec. 15, 2003, website.
Jacuzzi Whirlpool Bath, "Shower Base Installation Instructions", Feb. 2003, commercial publication.
Fiber Care Baths, Inc. "HydroBerm Bumps Up Tub Safety", brochure.
Lasco Bathware, Inc., "Installation Data; Shower Pans (Lascoat & Acrylic)" (Apr. 2004).

* cited by examiner

*Primary Examiner*—Huyen Le
(74) *Attorney, Agent, or Firm*—P. N. Dunlap, Esq.; J. A. Thurnau, Esq.; J. L. Mahurin, Esq.

(57) ABSTRACT

A shower receptor with improved control of moisture and trapped water comprising one or more of the following improvements: the flange is significantly higher above the threshold than prior art receptors; the threshold is disposed higher than the ledge area where the shower wall materials meet the receptor; weep valleys are provided in the corners of the ledge area and where the ledge meets the threshold; the ledge area comprises multiple steps adapted to meet the subwall and finish wall materials wherein the steps are sloped toward the base and the tile step is lower than the subwall step; a raised curb is provided along the outer edge of the horizontal surface of the threshold, the curb adapted to redirect water that leaks out of the door enclosure back into the shower receptor.

25 Claims, 7 Drawing Sheets

SHOWER RECEPTOR

BACKGROUND OF THE INVENTION

This invention relates to a shower receptor or shower pan. This invention also relates to a shower stall using the shower receptor. This invention also relates to a bathtub.

One piece molded shower receptors are known in the art. U.S. Pat. No. 2,757,385 to W. W. Whittick and U.S. Pat. No. 3,800,335 to Anthony Buonaura disclose examples of conventional shower receptors. These shower receptors were designed to replace tile and mortar bed shower floors which were prone to leaking. They were designed to mate with various conventional wall construction materials. Shower subwalls are conventionally constructed of cement mortar, gypsum board, cementitious backer, coated glass mat backer board, or cementitious coated foam backer board and the like. Shower wall surfaces are conventionally finished ceramic or porcelain tile, stone, marble or prefabricated sheet materials, which are attached with thin set mortar or adhesive.

Even though the conventional shower receptors may solve the problem of water leakage that is associated with tile shower floor construction, there are still water leakage problems associated with stone-, marble- or tile-covered interior shower walls. All tile and stone walls with grout lines leak and pass water. Grout lines are not waterproof and they are generally not maintained in a way that will prevent this occurrence. With age and use, cracks and/or holes may develop in the tile wall, allowing increasing amounts of water to seep into the wall. The water will travel horizontally and vertically behind the tile. When it reaches the bottom of the wall, it generally cannot flow into the shower receptor because the joint where the tile wall and the shower receptor meet is generally sealed with silicone or other caulk. The water therefore travels horizontally until it finally escapes the shower enclosure, either soaking into adjacent walls or leaking onto floors outside the shower stall. Alternately, the trapped water may wick upward into the drywall, plaster or other subwall material of the shower walls. Either way, the water seepage behind the tile wall can cause significant damage in shower stalls using conventional shower receptors.

When a bathtub is installed in a combination bathtub-shower installation, the bathtub functions in the same way as the shower receptors described above. When tile, stone, or marble walls are used in such installations, the same water seepage problems occur as in the shower stalls described above.

What is needed is a shower receptor for a shower stall or bathtub installation having a flange that is significantly higher than the threshold and the ledge area. What is needed is a shower receptor having a ledge area that is lower in elevation than the threshold. What is further needed is a shower receptor having weep valleys in all corners of the ledge area. What is further needed is a shower receptor having a ledge area with more than one step adapted for mating with various subwall materials. The inventive shower receptor meets these needs.

BRIEF SUMMARY OF THE INVENTION

The invention is directed to a shower receptor wherein the ledge area that is adapted to support the subwall and finish wall materials is disposed lower in elevation than the threshold. The invention is also directed to a shower receptor wherein the ledge area comprises multiple steps, the outer steps being higher than the inner steps, all steps sloping inward and adapted to support or mate with shower wall materials. The invention is also directed to a shower receptor wherein the ledge area has weep valleys located in each corner and sloping toward the base and adapted for directing water toward the base. The invention is also directed toward a shower receptor having a vertical flange extending upward from the ledge area at least about three inches above the ledge. The invention is also directed toward a shower receptor having a raised curb formed on the outer edge of the threshold.

DETAILED DESCRIPTION OF THE INVENTION

Figure 1:
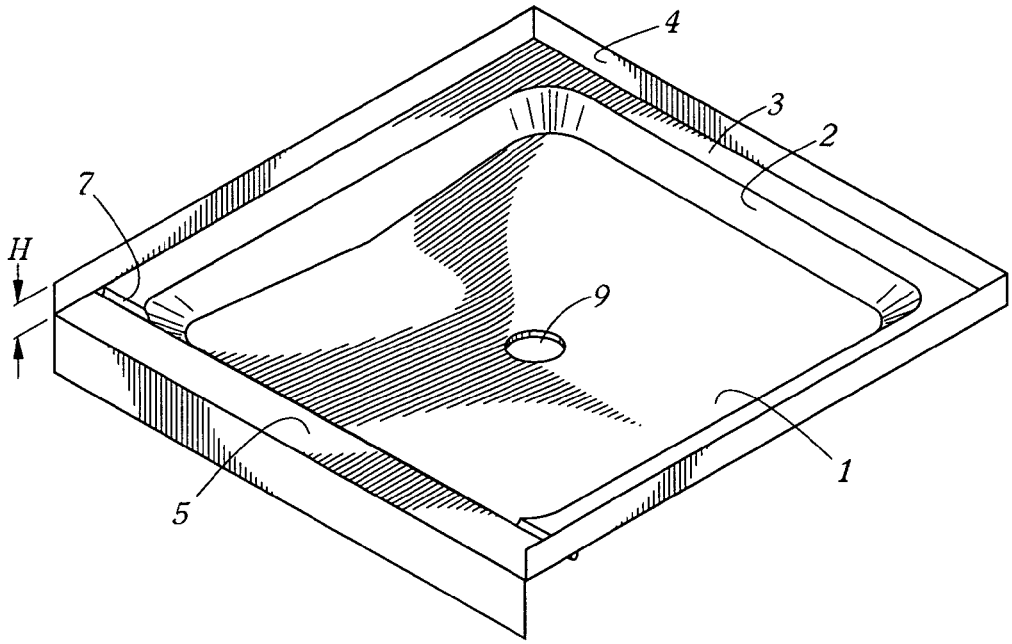
FIG. 1 PRIOR ART
FIG. 1 is a perspective view of a prior art shower receptor.
Figure 2:
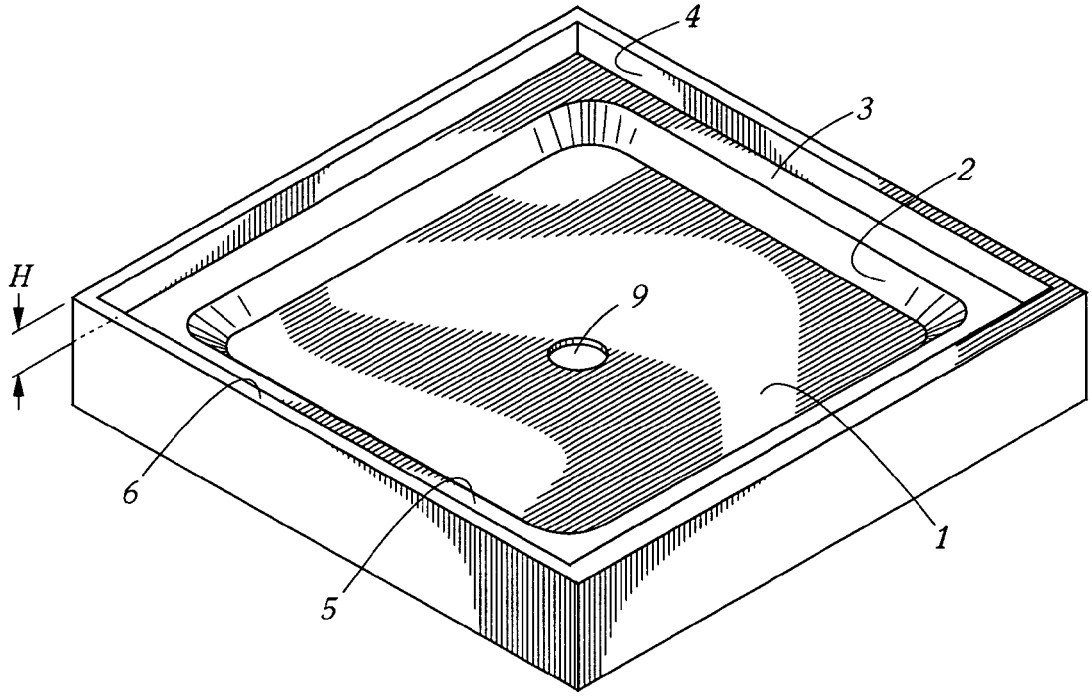
FIG. 2 PRIOR ART
FIG. 2 is a perspective view of a second prior art shower receptor.

FIGS. 1 and 2 show prior art shower receptors. They have a base 1 sloped toward a central drain hole 9. Sidewalls 2 extend upward from the edges of the base 1 forming a pan. Ledge 3 extends horizontally, laterally, outward from the top edge of the sidewalls 2 on three sides. A horizontal threshold 5 extends horizontally from the top edge of the sidewall on the fourth side. Flange 4 extends upward from the outer edge of the ledge. The height H of the flange above the ledge is typically up to about one inch in prior art shower receptors.

Referring to the prior art shower receptor of FIG. 1, the threshold and ledge are disposed at the same height relative to the base. Weep valley 7 may be present at the intersection of the ledge 3 and the threshold 5, but not in the other corners of the ledge 3.

Referring to the prior art shower receptor of FIG. 2, curb 6 extends upward from the outer edge of the threshold 5. Threshold 5 and ledge 3 are the same height relative to the base. Curb 6 and flange 4 are the same height H above the threshold 5 and ledge 3, respectively. The height H is generally about one inch.

FIGS. 3 through 6 and 10 show several embodiments of the inventive shower receptor. The one-piece, molded shower receptor of the invention may be formed from any suitable thermoset or thermoplastic molding material according to conventional molding techniques. For example, sheet molding compound (SMC) may be placed in a two piece mold and formed and cured under pressure and heat. SMC may comprise any of the known suitable resins, fiber or particle fillers and reinforcements, pigments, curatives. Alternatively, a lamination process of more than one suitable material may be used. For example, the receptor may comprise a gel coat or a vacuum-formed acrylic sheet over layers of chopped-glass reinforced resin and/or various reinforcing materials or structures applied in an open mold. These construction details are offered by way of example, not meant to limit the scope of the invention.

The shower receptors of FIGS. 3 through 6 have a square footprint and are designed for use in shower stalls having square footprints with a threshold on one side and shower walls on the other three sides. As will become apparent from the following descriptions, the invention is adaptable for use in shower stalls having a rectangular or curvilinear or any other footprint. The invention is also adaptable for use in corner shower stalls having shower walls on two sides and a threshold on at least two sides. The invention is also adaptable for use in combination bathtub and shower installations as illustrated by the bathtub embodiment shown in FIG. 10.

Figure 3:
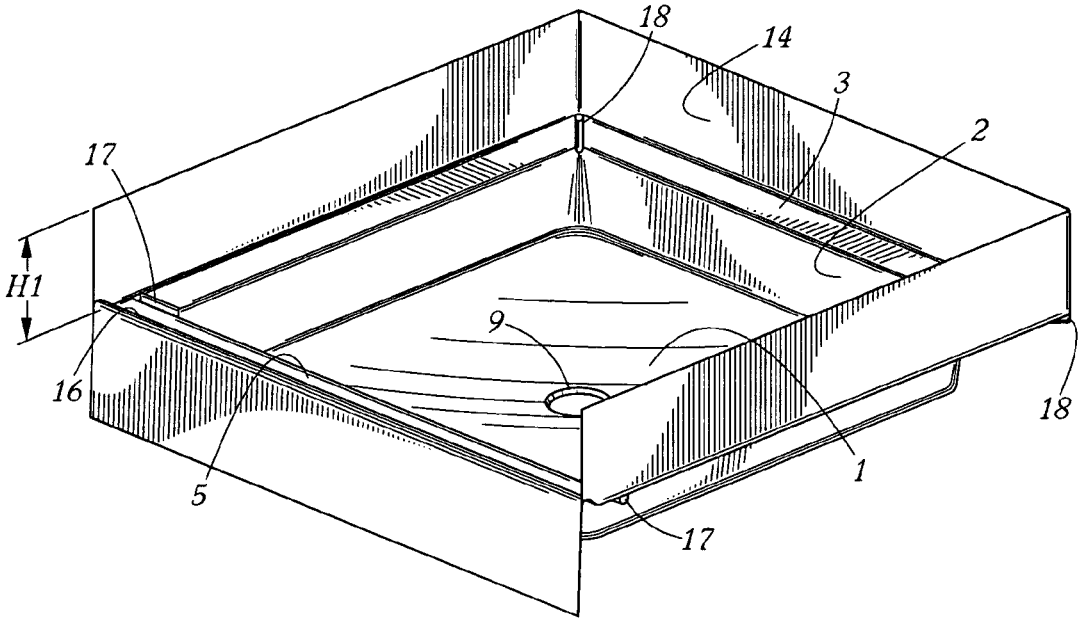
FIG. 3 is a perspective view of one embodiment of the invention.

Referring to FIG. 3, the square shower receptor of one embodiment of the present invention is shown having a base 1 sloped toward a drain hole 9 which may be located anywhere in the base as long as it is at the lowest point. At its periphery, the base 1 curves upward forming vertical side walls 2 on all sides. In other words, sidewalls 2 extend upward from the edges of the base 1. Ledge 3 extends horizontally, laterally, outward from the top edge of the sidewalls 2 on three sides. A horizontal threshold 5 extends horizontally from the top edge of the sidewall on the fourth side. Flange 14 extends upward from the outer edge of the ledge 3. In an embodiment of the invention, the height H1 of flange 14 above ledge 3 and threshold 5 is at least about three inches, which is significantly higher than conventional shower receptors. It has been found that increased flange height leads to improved water tightness of the shower stall for reasons that should become clear when installation of the shower receptor is discussed below.

Curb 16 extends upward from the outer edge of the horizontal surface of threshold 5. Curb 16 is adapted to prevent water egress over the threshold. Typically a shower door is supported by a metal track which is mounted on the threshold. The curb height above the threshold should be at most about the height of the metal track so as not to interfere with the opening of the door. Thus the curb height is much less than height H1. Water typically leaks past the shower door and collects on the threshold. In one embodiment of the invention the curb prevents the water from leaving the shower receptor, instead directing the water back toward the base. Conventional shower receptors have a flat threshold surface, possibly with some inward slope. Water that gets past the shower door is most likely to run out of a conventional shower receptor having a conventional threshold. The curb feature of this invention solves this problem.

In the embodiment of the invention shown in FIG. 3, weep valleys 17 are disposed where ledge 3 intersects threshold 5 and are disposed parallel to the threshold. In addition, weep valleys 18 are disposed in each corner of the ledge 3 extending diagonally across the ledge from the corner of the flange to the corner of the sidewall. Weep valleys 17 and 18 slope toward the base, being adapted to collect water sitting on the ledge and direct it toward the base. Prior art shower receptors have only had weep valleys 17 at the intersection of the threshold and the ledge. Adding the additional weep valleys 18 to the other corners of the ledge has been found to dramatically improve the drainage of trapped water from behind tiled shower walls back into the base. The slope of the weep valleys toward the base is not particularly limited, but may be about six degrees.

Figure 4:
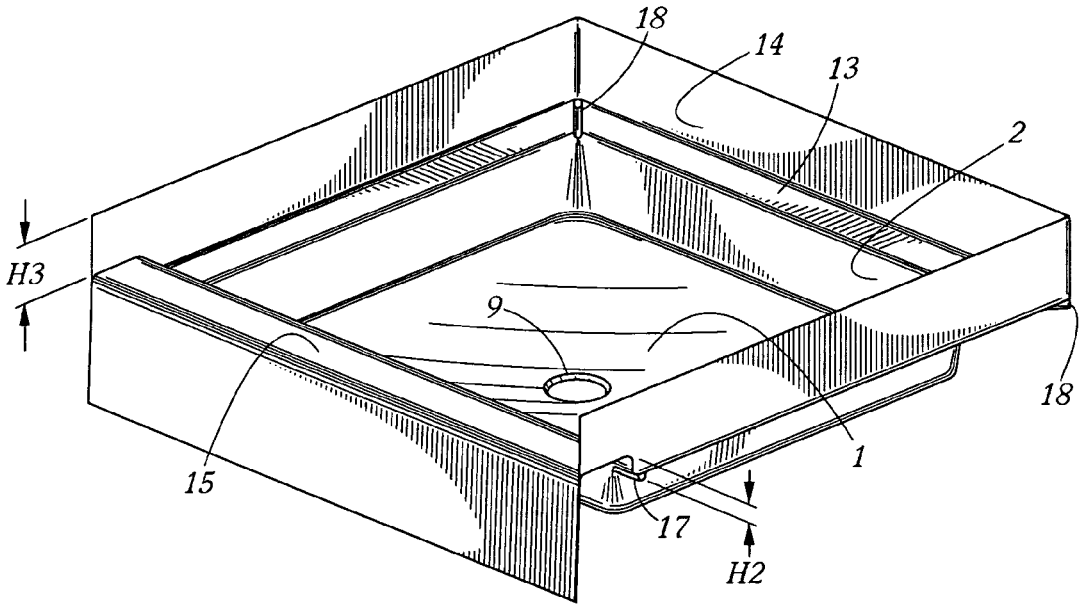
FIG. 4 is a perspective view of a second embodiment of the invention.

Referring to FIG. 4, a second embodiment of the invention is shown having similar base 1, sidewalls 2, and flange 14 at height H3 above threshold 15. Ledge 13 again extends laterally from the top of sidewall 2 on three sides of the base. In this embodiment of the invention, however, the ledge 13 is disposed lower in elevation with respect to the base than threshold 15. The difference in height H2 between ledge 13 and threshold 15 may be up to about 6 inches. In one embodiment, H2 is in the range from about 2 inches to about 5 inches. By disposing the ledge lower than the threshold, or in other words the threshold higher than the ledge, water trapped behind the tile wall of the shower is prevented from escaping the shower receptor when flowing horizontally along the ledge. In cooperation with the improved water-trapping ability of the higher threshold and lower ledge, weep valleys 17 and 18 provide greatly improved means of directing trapped water back into the base of the shower receptor. In an embodiment of the invention, height H3 of flange 14 above threshold 15 is at least about one inch, and height H2 of threshold 15 above ledge 13 is about 2.5 inches. Thus, height H2+H3 of flange 14 above ledge 13 is at least about 3.5 inches.

Figure 5:
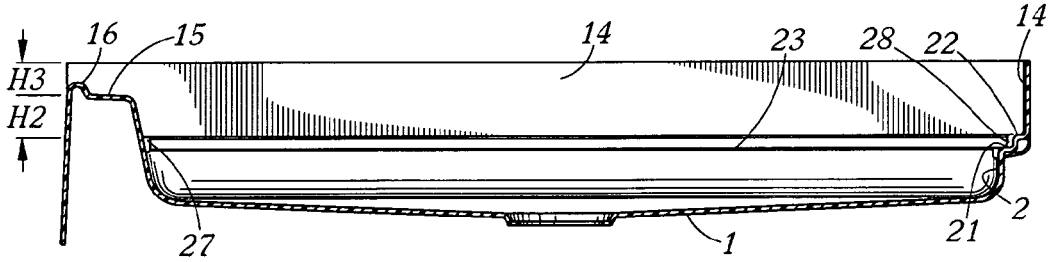
FIG. 5 is a side elevation sectional view of a third embodiment of the invention.

Referring to FIG. 5, a cross section of a third embodiment is shown having similar base 1, sidewalls 2, and flange 14 at height H3 above threshold 15. Again, curb 16 is shown extending upward from the outer edge of threshold 15. In this embodiment of the invention, a more complex ledge area 23 extends laterally from the top of sidewall 2 on three sides of the base. Ledge area 23 comprises two steps 21 and 22. First step 21 is disposed lower in elevation with respect to the base than second step 22. First step 21 is also closer to the base than second step 22. Both steps may be sloped toward the base to facilitate drainage of water toward the base. The amount of slope is not particularly limited but may be up to about six degrees or more. In this embodiment of the invention, ledge area 23 is disposed lower in elevation with respect to the base than threshold 15. The difference in height H2 between ledge 23 and threshold 15 may be up to about 6 inches. In an embodiment of the invention, height H3 of flange 14 above threshold 15 is at least about one inch, and height H2 of threshold 15 above ledge 23 is at least about 2.5 inches. Thus, height H2+H3 of flange 14 above ledge 23 is at least about 3.5 inches.

In cooperation with the improved water-trapping ability of the higher threshold and lower ledge, weep valleys 27 and 28 provide greatly improved means of directing trapped water back into the base of the shower receptor. Weep valleys 27 and 28 are shown as having uniform downward slope, extending from the bottom of the flange 14 to the top of the side wall 2. Thus, the depth of the valleys varies as it crosses the ledge area because of the two steps which define one side of valleys 27 and both sides of valleys 28. Alternatively, the weep valleys could be made of uniform depth, thus having two steps.

Second step 22 is adapted in horizontal width to accommodate the thickness of the subwall materials used to construct the shower walls. For backer board subwalls, the width of second step 22 may be around half an inch. For plaster or scratch coat and mortar subwalls, the width of second step 22 may be around one and a quarter inches. The first step 21 is adapted in horizontal width to accommodate the thickness of the ceramic tile, stone, or marble used to finish the shower walls, typically about one quarter to one half inch. Alternately, the first step 21 may be adapted in horizontal width to accommodate the thickness of prefabricated sheet material such as fiberglass wall panel, cultured marble or the like. The lower and upper ledges differ in elevation by a height adapted to prevent water trapped behind the tile from wicking into the rough wall material. This height may be at least about ¼ inch according to Tile Council of America standards, but is not limited to any particular distance. The dual-step ledge feature of the present invention provides definite guidance during installation for location of the backer board, mortar bed or other subwall material. The dual ledge assures that the base of the subwall will be higher than the lower edge of the tile and the silicone bead. Thus trapped water will be prevented from wicking up the materials. Some conventional shower receptors have no ledges at all to guide the installers, or to prevent the rough wall materials from contacting the shower pan and wicking up any water that is available. Other conventional shower receptors have a ledge and a trough in close proximity so that water trapped in the trough can immediately be wicked up into the rough wall material. Other conventional shower receptors do not allow the subwall materials to overlap the flange at all.

Figure 6:
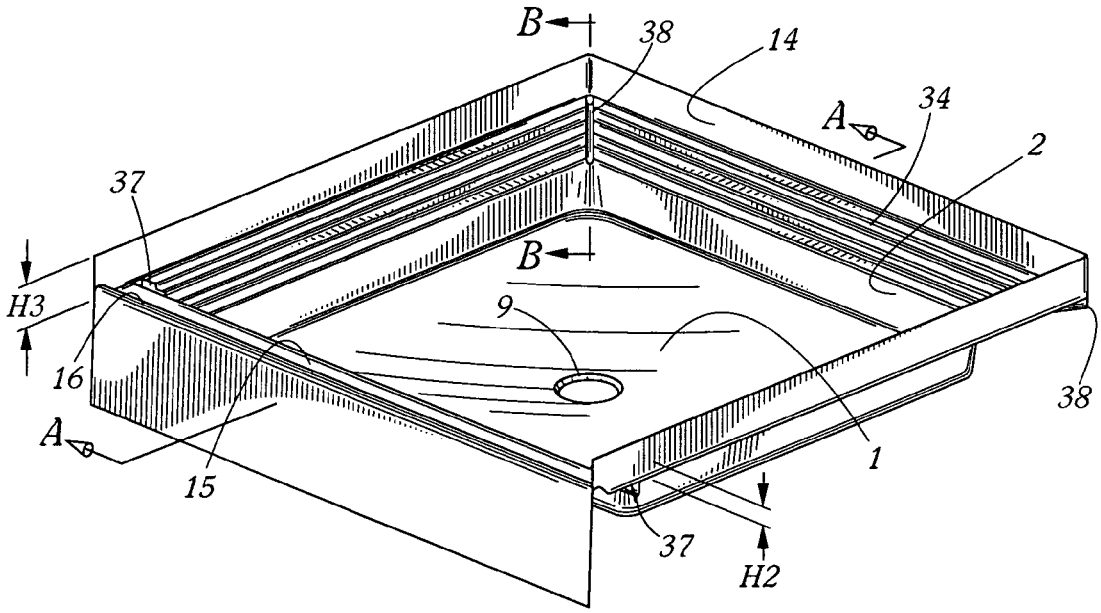
FIG. 6 is a perspective view of a fourth embodiment of the invention.
Figure 6A:
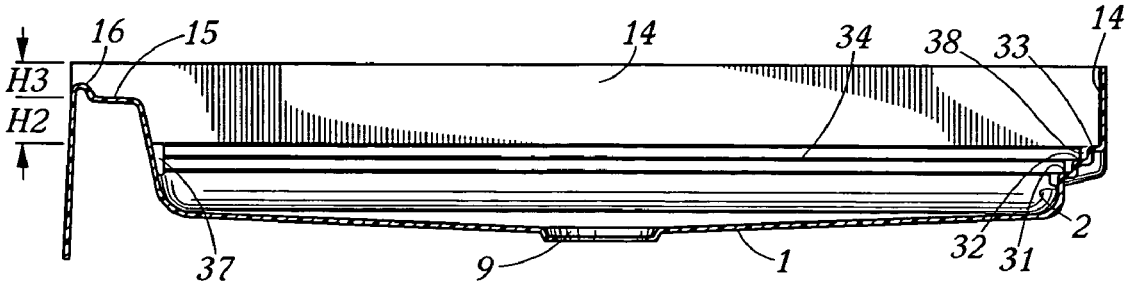
FIG. 6A is a side elevation sectional view along line A-A of the embodiment of FIG. 6.
Figure 6B:
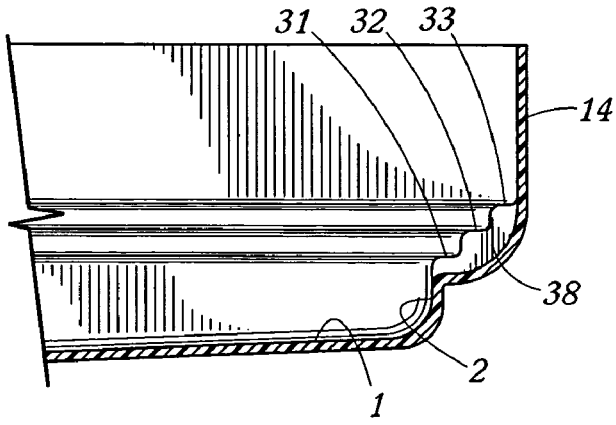
FIG. 6B is a fragmentary sectional view along line B-B of the embodiment of FIG. 6.

Referring to FIG. 6, a perspective view of a fourth embodiment is shown having similar base 1, sidewalls 2, and flange 14 at height H3 above threshold 15. Again, curb 16 is shown extending upward from the outer edge of threshold 15. In this embodiment of the invention, a more complex ledge area 34 extends laterally from the top of sidewall 2 on three sides of the base. FIGS. 6A and 6B show that ledge area 34 comprises three steps 31, 32 and 33. First step 31 is disposed lower in elevation with respect to the base than second step 32, which is lower in elevation than third step 33. First step 31 is also closer to the base than steps 32 and 33. All steps may be sloped toward the base to facilitate drainage of water toward the base. The amount of slope is not particularly limited. In this embodiment of the invention, ledge area 34 is disposed lower in elevation with respect to the base than threshold 15. The difference in height H2 (shown in FIG. 6) between ledge area 34 and threshold 15 may be up to about 6 inches. In an embodiment of the invention, height H3 (as shown in FIGS. 6 and 6A) of flange 14 above threshold 15 is at least about one inch, and height H2 (as shown in FIG. 6A) of threshold 15 above ledge 33 is at least about 2.5 inches. Thus, height H2+H3 of flange 14 above ledge 33 is at least about 3.5 inches.

The steps 31-33 are adapted in horizontal width to accommodate the thickness of various subwall materials used to construct the shower walls. For backer board subwalls, the width of third step 33 may be around half an inch, thus providing a guide for installation of half-inch thick subwalls. For plaster or scratch coat and mortar subwalls, the width of second step 32 and third step 33 combined may be around one and a quarter inches, thus providing a guide for installation of mortar subwalls. The first step 31 and second step 32 are adapted in horizontal width to accommodate the thickness of the ceramic tile, stone, or marble used to finish the shower walls, typically about one half inch per step. Thus, the second step would be the guide for finish wall materials when half-inch backer board subwalls are used, but the first step would be the guide for finish wall materials when thicker mortar subwalls are used. The three steps differ in elevation by a height adapted to prevent water trapped behind the tile from wicking into the rough wall material. This height difference may be at least about ¼ inch for each step according to Tile Council of America standards, but is not limited to any particular distance. The tri-step ledge feature of the present invention provides definite guidance during installation for location of the backer board, mortar bed or other subwall material. The tri-step ledge assures that the base of the subwall will be higher than the lower edge of the tile and the silicone bead. Thus trapped water will be prevented from wicking up into the subwall materials.

Figure 7:
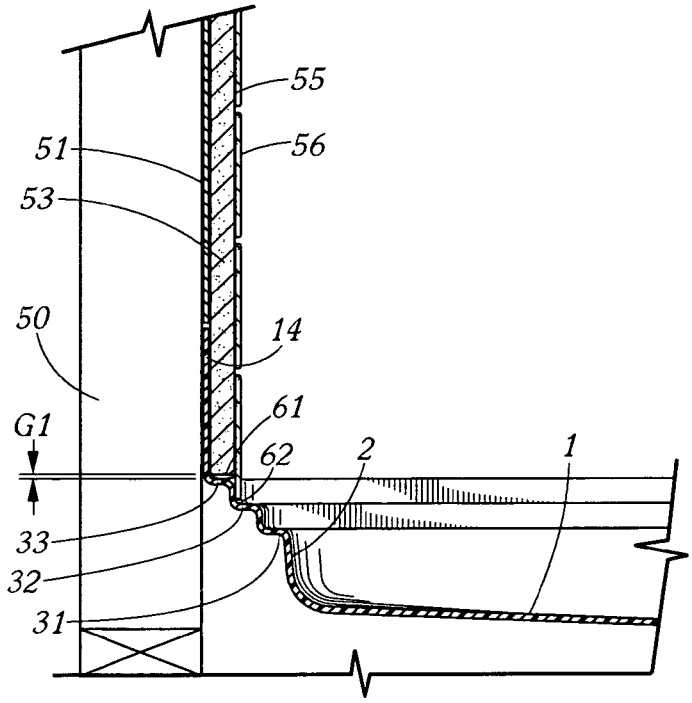
FIG. 7 is a cross section of an embodiment of the invention.
Figure 8:
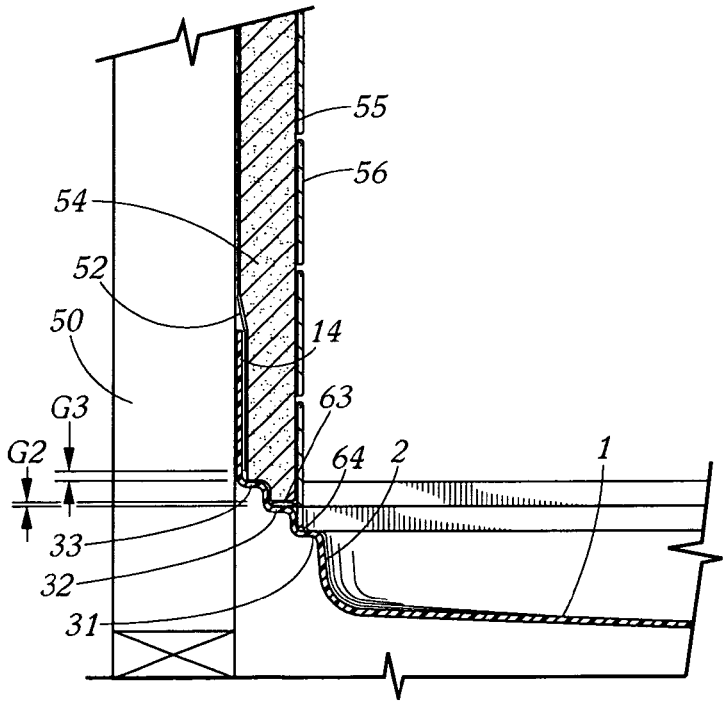
FIG. 8 is a cross section of an embodiment of the invention.
Figure 9:
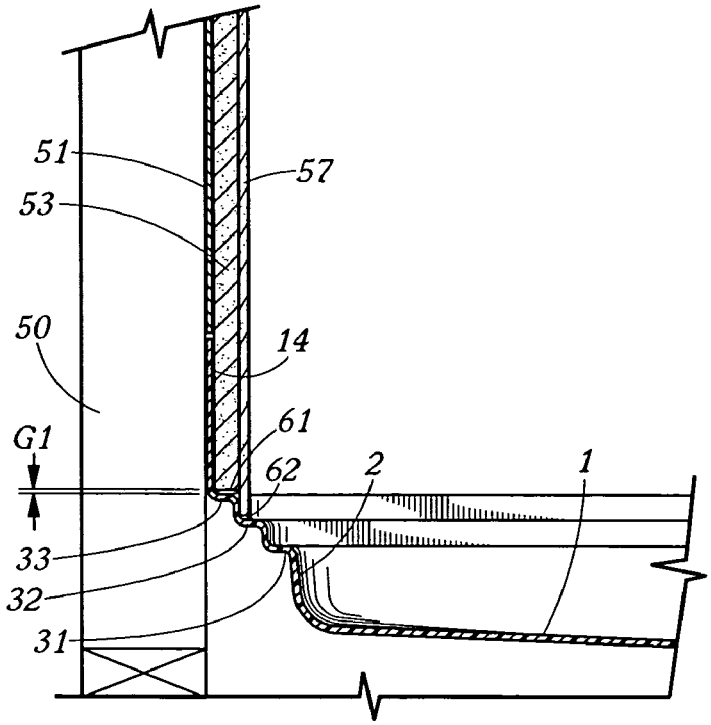
FIG. 9 is a cross section of an embodiment of the invention.

FIGS. 7-9 illustrate shower stalls constructed with the inventive shower receptor and various shower wall materials. Referring to FIG. 7, an embodiment of the shower receptor is shown with a ledge area having three steps 31, 32, and 33. Furring strips 51 are mounted on stud 50 in order to compensate for the thickness of flange 14. Water resistant backer board 53 is mounted to studs, overlapping flange 14, and leaving about a ¼-inch gap G1 between the bottom edge of the board and third step 33. Mildew-resistant silicone sealant or equivalent caulk 61 is applied to the gap G1. Tile 56 is attached to backer board 53 using adhesive or bond coat 55, and caulk 62 is applied to the joint between tile and second step 32.

Referring to FIG. 8, a shower installation comprising lath and plaster is shown for illustrative purposes. Membrane 52 is attached to stud 50, overlapping flange 14 at least one inch, but leaving gap G3 of at least about one inch between membrane 52 and third step 33. Subwall 54 comprises scratch coat and mortar bed on lath. Gap G2 of about ¼ inch between bottom edge of subwall 54 and second step 32 is filled with caulk 63. Tile 56 is attached to subwall 54 using adhesive or bond coat 55, and caulk 64 is applied to the joint between tile and first step 31. A time- and cost-saving feature of this invention is that furring strips to compensate for the thickness of the flange 14 and prevent movement of the membrane are not necessary, but are optional.

Referring to FIG. 9, a shower installation comprising prefabricated sheet material 57 such as fiberglass wall panel, cultured marble or the like is shown. Again, furring strips 51 are mounted to framing studs 50 to provide a flat surface for mounting water resistant backer board 53. Gap G1 of about ¼ inch between bottom edge of backer board 53 and third step 33 is filled with caulk 61. Sheet material 57 is applied to backer board with suitable adhesive.

Figure 10:
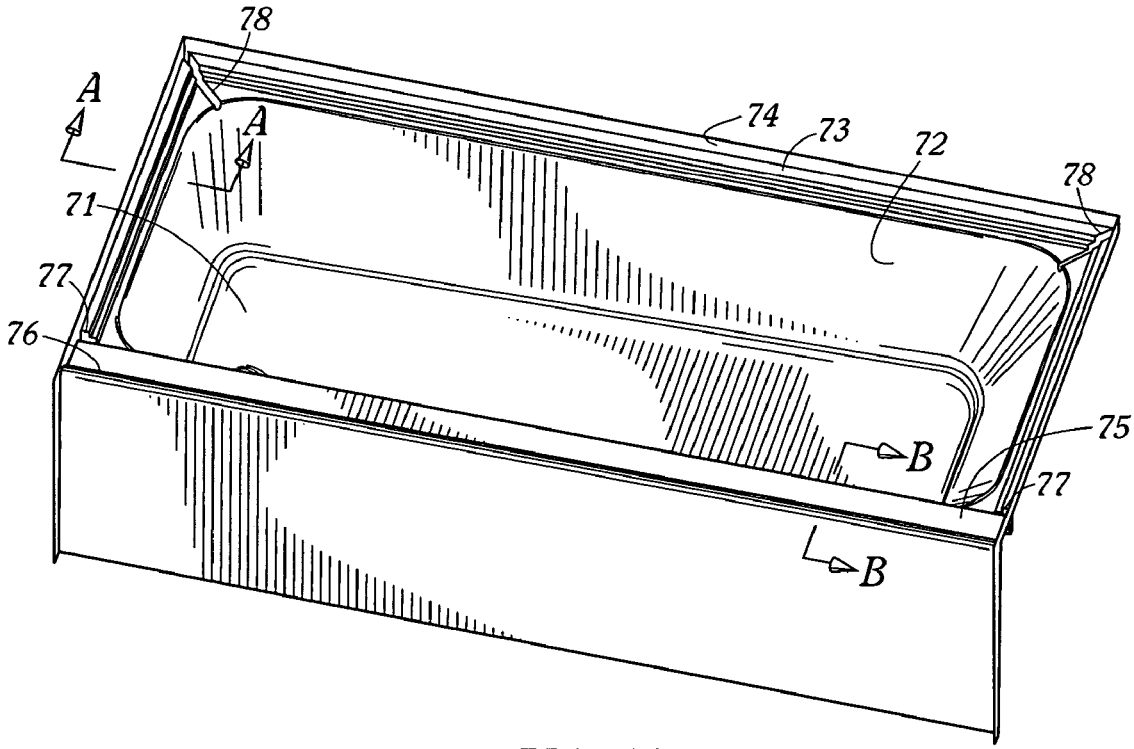
FIG. 10 is a perspective view of another embodiment of the invention.
Figure 10A:
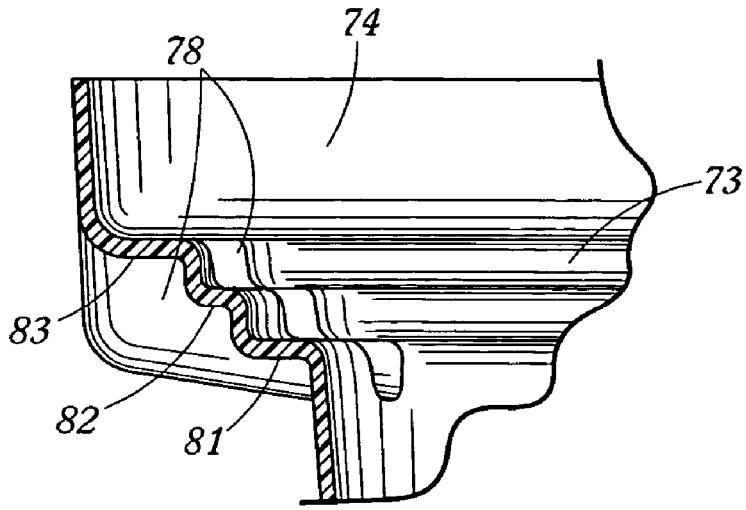
FIG. 10A is a fragmentary sectional view along line A-A of the embodiment of FIG. 10.
Figure 10B:
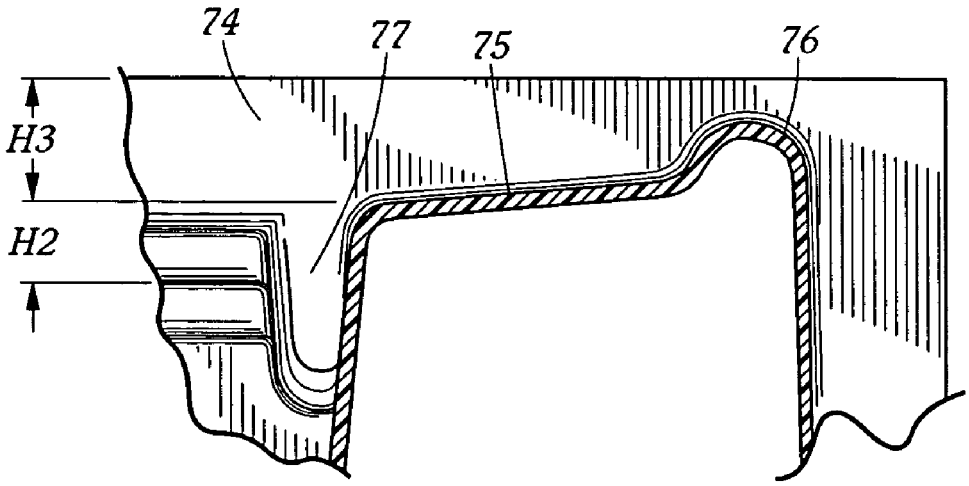
FIG. 10B is a fragmentary sectional view along line B-B of the embodiment of FIG. 10.

Referring to FIG. 10, a bathtub according to the present invention is shown. As in the other shower receptors, the bathtub has a base 71 sloping toward the drain hole and surrounded by sidewall 72. The primary difference between the bathtub and the shower receptors discussed above is that the bathtub has much taller sidewalls adapted for holding bath water. The bathtub has on one side a horizontal threshold 75 extending outward from the top edge of the side wall 72. According to the embodiment shown, the outer edge of the threshold has a raised curb 76 which prevents water from running off of the threshold onto the floor. On the other three sides, there is a horizontal ledge area 73 extending laterally from the top edge of the sidewall 72 and disposed lower in elevation than the threshold by a vertical distance H2 of about two to about six inches. There is a vertical flange 74 extending upward from the outer edge of the ledge area 73. The flange 74 extends a distance H3 of at least one inch above the threshold. The flange 74 also extends a distance H2+H3 of at least about three inches above the ledge area 73. The ledge area 73 may comprise one horizontal surface or a series of more than one step. For the embodiment shown in FIG. 10, ledge area 73 comprises three steps 81-83. The purpose and dimensions of the second and third steps 82 and 83 are the same as for shower receptors discussed above. The first step 81 is typically wider in bathtubs than in shower-only receptors, providing a ledge for placing objects and containers used in bathtubs and for leverage for the user to get in and out of the tub. The four corners of the bathtub have weep valleys 77 and 78. FIG. 10A is a magnified partial section near a rear corner weep valley 78. FIG. 10B is a magnified partial section near a front corner weep valley 77.

Other known features of shower receptors may be incorporated into the present invention without detracting from its usefulness. The horizontal threshold surface 5 or 15 and horizontal ledge surfaces 3 or 13 or 23 may be sloped toward the base to facilitate draining of water into the receptor 1. The amount of slope is not particularly limited. The base may be embossed with various surface patterns for esthetic purposes or to prevent slipping during use. The under side of the base may be supported or reinforced by various molded in web or rib features. Likewise the threshold, side walls, ledge or flange may have various external support structures. The drain hole may be adapted for various types of drain fixtures. The flange and side walls may be drafted or slightly sloped outward from the base to facilitate demolding and/or nested stacking of shower receptors for storage or shipping. Shower receptors adapted for use as bathtubs may have one or more holes in the base and/or sidewall for drain hardware, jets, and the like. The tiling flange may be extended in front of the threshold as illustrated in FIG. 10. Other optional features will be apparent to one skilled in the art.

Conventional methods of installation of a shower receptor include the steps of fitting the receptor into a framed alcove so that it sits level; fastening (for example with nails or screws) the flange to the studs; applying backer board, scratch coat and mortar bed, or other subwall material to the studs so that the subwall abuts the top edge of the flange, or preferably overlaps the flange and stops just short of the horizontal ledge surface; applying suitable adhesive and finishing the wall with ceramic tiles, stone or marble, the finish material meeting the horizontal ledge surface; and applying silicone or other suitable sealing material at the joint between tile and ledge surface. According to known methods of installation, when the backer board or other subwall material overlaps the flange, it is usually recommended that the backer board not be allowed to touch the ledge in order to prevent trapped water on the ledge from wicking up into the subwall. In an embodiment of the present invention it is recommended that installation of the shower receptor comprises the steps of leaving a ¼-inch gap between the bottom edge of the subwall and the horizontal surface of the ledge of the shower receptor; and applying a bead of silicone sealant or the like in the ¼-inch gap between the subwall and the horizontal surface of the ledge. This additional sealant step more reliably prevents water from wicking up into the subwall than use of a gap only. Maintaining a uniform subwall gap during installation requires considerable skill, while applying sealant is relatively easy even if the gap varies in width considerably.

In another embodiment of the present invention it has been found that having a flange of height H2+H3 of at least about three inches above the ledge area greatly facilitates installation of the subwall materials, leading to improved control of moisture. The increased height over conventional flanges makes it much easier for the installer to lap the subwall over the flange. Furring strips or other types of shims may be installed on the framing stubs to compensate for the thickness of the flange before installing wallboard or mortar systems. When the flange height is maintained at least about three inches above the ledge area, furring or shimming is not required for scratch coat and mortar bed subwalls, thus reducing installation time and cost. This benefit is realized as long as the membrane, which is installed under the mortar bed, overlaps the flange at least about one inch, while leaving at least about one inch gap between the bottom of the membrane and the horizontal ledge area. Without the increased flange height above the ledge area, there is not sufficient overlap of the membrane to prevent loss of overlap from movement of the membrane during application of the mortar bed, thus requiring furring strips to prevent membrane movement. With the higher flange of this invention, there is sufficient overlap of the membrane to accommodate membrane movement during installation without need for furring strips. The higher flange also allows the fastening screws to be covered with membrane and subwall materials while easily retaining a gap between the bottom edge of the subwall and the horizontal ledge surface.

According to known methods of installation it is known to leave small gaps or holes in the sealant between the tile or other finish wall material and the shower receptor so that trapped water can escape from behind the tile. Unfortunately, routine maintenance, often performed by homeowners or others not skilled in the art, often leads to the holes being filled with caulk, leaving no way for the trapped water to escape into the receptor. According to an embodiment of the present invention, provision of weep valleys provides a visible reminder to the installer and the maintainer of the shower receptor to leave these areas free of caulk. Combining weep valleys with a multi-step ledge area provides particularly deep valleys that are not only highly visible reminders to installers not to caulk, but are also quite difficult to fill with caulk. Alternately, porous materials, such as grout can be used to fill the joint between the finish wall and the receptor, while leaving the weep valleys free of all material.

According to another embodiment of this invention, provision of a dual- or tri-step ledge area greatly facilitates installation of both subwall and finish wall materials. The separate steps adapted for the subwall and the finish wall provide guides that guarantee the bottom edge of the subwall will be elevated above the bottom edge of the finish wall. This helps insure that water trapped behind the finish wall will not wick up into the subwall. When scratch coat and mortar bed construction are used for the subwall, the second step provides a convenient float guide for making a subwall of uniform thickness, while the first step again provides a guide for the tile or other finish material.

A three-step ledge area provides for ease of use of a single shower receptor with various types of shower wall construction. A shower wall of backer board and tile may use only the outermost two steps. A shower wall of mortar and lath with tile may use the outer two steps for the mortar and lath and the innermost step for the tile. Other multi-step arrangements consistent with the present invention may be envisioned by one skilled in the art.

A test was conducted with an embodiment of the invention similar to FIG. 6. Four example shower stalls were constructed using four identical such shower receptors, glass doors, and various types of wall materials. The shower receptors were formed using a gel-coat and fiberglass reinforced resin laminate construction in prototype molds constructed for the purpose. Each stall had three shower heads directed at the walls providing twenty gallons per minute of water flow for eight weeks, five days per week. The shower stalls were inspected daily on all four exterior sides for leaks. After the test period, the stalls were completely disassembled to look for evidence of leaks.

The shower stall of Example 1 had cultured marble sheet materials for finish walls. All joints were sealed with standard silicone caulk, with the exception of the weep valleys. As one might expect, there was no leakage from the shower because these walls had no grout lines, only corner joints, and these wall materials are impervious to water.

The shower stall of Example 2 had a subwall of membrane, lath, and mortar construction, without furring strips, according to the installation procedures described above. The finish wall was ceramic tile and sanded grout, neither of which was sealed. The ¼-inch gap between subwall and ledge was sealed with silicone caulk and the gap between tile and ledge was sealed also, but again excluding the weep valleys. More surprisingly this time, there was again no leakage of water out of the shower stall.

The shower stall of Example 3 had a subwall of cementitious backer board, installed as described above, and a finish wall of ceramic tile. The walls were finished with grout and caulk as in Example 2. The results were the same as in Example 2.

The shower stall of Example 4 was constructed with a transparent plastic window material as the subwall, in place of the usual backer board. Then it was finished with tile, grout and caulk as in Example 3. The purpose of the clear backer was to allow observation of the flow of water which might leak behind the tile and to confirm visually the excellent results of Examples 2 and 3. As explained in the background section, the grout and tile did allow significant amounts of water to leak through and become trapped between subwall and finish wall. The water traveled vertically, following the voids created by the use of a v-notched trowel when spreading the tile adhesive. The adhesive was purposely applied with vertical strokes of the trowel to minimize horizontal flow of trapped water. When the trapped water reached the bottom of the wall, the silicone caulk stopped the vertical flow, causing it to pool. When the water pooled to a depth of about a half inch, it flowed horizontally along the ledge until it reached the weep valleys. Then the water drained along the weep valleys back into the shower receptor and down the drain. No water leaked out of the stall.

The performance of conventional shower receptors in such tests is well known by those skilled in the art of installing and replacing shower stalls. If the receptor had been of conventional design in this test, the trapped water would have easily run out of the shower stall over the threshold. Without weep valleys, or with the inadequate prior art valleys, the water would have pooled behind the tile much higher than a half inch, allowing water to run out over a conventional one-inch flange as well as over the threshold. Without the threshold disposed higher than the ledge, the water flowing along the ledge would have no resistance to leaving the receptor. Without the significantly higher flange and the improved overlap of building materials, the pooled water would have risen high enough to escape over the flange. Pooled water also would have wicked into the subwall and traveled into surrounding porous materials such as studs and drywall.

Thus the present invention provides a shower receptor, including a bathtub, with improved control of moisture and trapped water comprising one or more of the following improvements: the flange is significantly higher above the ledge area than prior art receptors; the threshold is disposed higher than the ledge area where the shower wall materials meet the receptor; weep valleys are provided in the corners of the ledge area and where the ledge meets the threshold; the ledge area comprises more than one step adapted to meet the subwall and finish wall materials wherein the steps are sloped toward the base and each successive step proceeding inward from the flange toward the base is progressively lower in elevation; a raised curb is provided along the outer edge of the horizontal surface of the threshold, the curb adapted to redirect water that leaks out of the door enclosure back into the shower receptor; and installation instructions for shower receptors with lath and mortar subwalls include the step of installing the membrane with at least a one-inch overlap of the flange and at least one-inch gap between bottom of membrane and the ledge area of the shower receptor.

Although the present invention has been described in detail for the purpose of illustration, it is to be understood that such detail is solely for that purpose and that variations can be made therein by one skilled in the art without departing from the spirit or scope of the present invention except as it may be limited by the claims. The invention disclosed herein may suitably be practiced in the absence of any element that is not specifically disclosed herein.

What is claimed is:

1. A shower receptor comprising:

a base having sidewalls extending upward from each edge of the base;

a threshold having a horizontal surface extending outward from the top edge of at least one of the sidewalls;

a ledge extending outward from the top edges of the remaining sidewalls; and a vertical flange extending upward from the outer edge of the ledge;

wherein the threshold is disposed higher in elevation than the ledge with respect to the base, and the flange extends higher than the threshold; and wherein the ledge comprises more than one step, the first step disposed closest to the base and lowest in elevation with respect to the base, and each subsequent step higher in elevation and farther from the base.

2. The shower receptor of claim 1 wherein the ledge comprises at least three steps, and the steps and/or the horizontal surface slope toward the base.

3. The shower receptor of claim 2 wherein the difference in elevation with respect to the base between each adjacent step is at least about one quarter inch.

4. The shower receptor of claim 1 wherein the flange extends above the threshold; the flange extends above the ledge at least about three inches; and the height of the horizontal surface of the threshold above the ledge is in the range of from about two to about five inches.

5. The shower receptor of claim 1 wherein the flange extends higher than the ledge at least about three inches; the flange extends above the threshold more than one inch; and the height of the horizontal surface of the threshold above the ledge is in the range of from about one to about six inches.

6. The shower receptor of claim 1 wherein the flange extends higher than the ledge at least about three inches; the flange extends above the threshold more than one inch; and the height of the horizontal surface of the threshold above the ledge is in the range of from about one to about six inches.

7. The shower receptor of claim 1 further comprising a raised curb on the outer edge of the horizontal surface of the threshold.

8. The shower receptor of claim 1 wherein the ledge further comprises front corners at the intersections of the threshold and the ledge and one or more other corners of the ledge, and valleys are formed diagonally in the other corners of the ledge.

9. The shower receptor of claim 1 wherein the height of the horizontal surface of the threshold above the ledge is in the range of from about one to about six inches.

10. A shower receptor comprising:

a base having sidewalls extending upward from each edge of the base;

a threshold having a horizontal surface extending outward from the top edge of at least one of the sidewalls; and a ledge extending outward from the top edges of the remaining sidewalls, with a vertical flange extending upward from the outer edge of the ledge, the flange extending higher than the threshold;

wherein the ledge comprises more than one step, the first step disposed closest to the base and lowest in elevation with respect to the base, and each subsequent step higher in elevation and farther from the base.

11. The shower receptor of claim 10 wherein the ledge comprises at least three steps, and each step slopes toward the base.

12. The shower receptor of claim 11 wherein the difference in elevation with respect to the base between adjacent steps is at least about one quarter inch.

13. The shower receptor of claim 10 further comprising a raised curb on the outer edge of the horizontal surface of the threshold.

14. The shower receptor of claim 10 further comprising valleys formed in the corners of the ledge, the valleys sloping toward the base for collecting water from the ledge and directing it into the base.

15. The shower receptor of claim 10 wherein the flange extends in the range of from about one to about six inches above the highest step.

16. The shower receptor of claim 10 wherein the dimensions of the sidewall, base, threshold and ledge are adapted for use as a bathtub.

17. The shower receptor of claim 10 adapted for installation in a corner with two shower walls wherein two adjacent sides have flanges and the other sides have thresholds.

18. The shower receptor of claim 10 installed in a shower stall or in a combination bathtub-shower stall.

19. The shower receptor of claim 10 wherein the flange extends higher than the ledge at least about three inches.

20. The shower receptor of claim 10 wherein the flange extends higher than the ledge at least about three inches, and the flange extends above the threshold more than one inch.

21. A shower receptor comprising:

a base having sidewalls extending upward from each edge of the base;

a threshold having a horizontal surface extending outward from the top edge of at least one of the sidewalls;

a ledge extending outward from the top edges of the remaining sidewalls with a vertical flange extending upward from the outer edge of the ledge, said ledge disposed lower than the threshold with respect to the base; the ledge further comprising front corners at the intersections of the threshold and the ledge and one or more other corners;

valleys formed parallel to the threshold disposed where the ledge meets the threshold, and valleys formed diagonally in the other corners of the ledge, the diagonal and parallel valleys sloping toward the base and adapted for collecting water from the ledge and directing it into the base; and a raised curb on the outer edge of the horizontal surface of the threshold, wherein the horizontal surface of the threshold is disposed higher in elevation than the ledge with respect to the base, and the flange extends higher than the threshold; wherein the flange extends higher than the threshold at least about one inch, and the flange extends higher than the ledge at least about three inches; and wherein the ledge comprises more than one step, the first step disposed closest to the base and lowest in elevation with respect to the base, and each subsequent step higher in elevation and farther from the base.

22. The shower receptor of claim 21 wherein the ledge comprises three steps.

23. A shower receptor as in claim 21 adapted for installation in a corner with two shower walls wherein two adjacent sides have flanges and the other sides have thresholds.

24. A shower receptor as in claim 21 wherein the dimensions of the sidewall, base, threshold and ledge are adapted for use as a bathtub.

25. The shower receptor of claim 21 installed in a shower stall or in a combination bathtub-shower stall.

* * * * *